United States Patent [19]

Aurelle et al.

[11] Patent Number: 4,889,537

[45] Date of Patent: Dec. 26, 1989

[54] METHOD FOR TREATING A FUEL COMPRISING A MIXTURE OF HYDROCARBONS AND ALCOHOLS, AND A SELECTIVE WATER-ADSORPTION PRODUCT

[75] Inventors: Yves Aurelle, Aucamville; Christian Bernasconi, Vernaison; Jean Besombes-Vailhe, Toulouse; Edmond Julien, Saint Jean; Henri Roques, Portet Sur Garonne, all of France

[73] Assignee: ELF FRANCE Societe Anonyme, Paris, France

[21] Appl. No.: 861,971

[22] Filed: May 12, 1986

[30] Foreign Application Priority Data

May 10, 1985 [FR] France ..... 85 07650

[51] Int. Cl.[4] ..... C10L 1/02

[52] U.S. Cl. ..... 44/53; 44/56

[58] Field of Search ..... 44/53, 56; 502/159

[56] References Cited

U.S. PATENT DOCUMENTS

| | | | |
|---|---|---|---|
| 2,861,045 | 11/1958 | Langer, Jr. | 502/159 |
| 2,862,979 | 12/1958 | Cull et al. | 502/159 |
| 3,442,924 | 5/1969 | Imura et al. | 502/159 |
| 3,988,122 | 10/1976 | Rosenthal et al. | 44/56 |
| 4,087,471 | 5/1978 | Bowman et al. | 44/56 |
| 4,154,580 | 5/1979 | Landis | 44/56 |
| 4,279,620 | 7/1981 | Sweeney | 44/56 |
| 4,334,890 | 6/1982 | Kochar et al. | 44/53 |
| 4,377,393 | 3/1983 | Schleppinghoff | 44/53 |
| 4,383,836 | 5/1983 | Wilson et al. | 44/56 |
| 4,398,920 | 8/1983 | Guibet et al. | 44/56 |
| 4,541,836 | 9/1985 | Derderian | 44/56 |
| 4,629,710 | 12/1986 | Smith, Jr. | 502/159 |

FOREIGN PATENT DOCUMENTS

| | | | |
|---|---|---|---|
| 0065687 | 1/1982 | European Pat. Off. | 502/159 |

*Primary Examiner*—William R. Dixon, Jr.
*Assistant Examiner*—Margaret B. Medley
*Attorney, Agent, or Firm*—Harold H. Dutton, Jr.

[57] ABSTRACT

A method for treating a fuel comprising a mixture of hydrocarbon(s) and alcohol(s) with a content by volume of alcohol less than 10%, the method comprising placing the fuel mixture in contact with at least one cationic exchange resin capable of strong dissociation into ion form in an aqueous medium, in particular a sulfonic or carboxylic resin which is prepared in potassium or magnesium form for adsorbing at least a portion of the water dissolved in the mixture on the resin so as to prevent segregation of the mixture and so as to stabilize the homogeneity of the fuel.

16 Claims, 2 Drawing Sheets

METHOD FOR TREATING A FUEL COMPRISING A MIXTURE OF HYDROCARBONS AND ALCOHOLS, AND A SELECTIVE WATER-ADSORPTION PRODUCT

The invention relates to a method for treating a fuel comprising of a mixture of hydrocarbon(s) and alcohol(s) with an alcohol content by volume of less than 10% and further covers a product for selectively adsorbing water in the presence of polar compounds.

BACKGROUND AND OBJECTS OF THE INVENTION

Alcohols, and in particular methanol and ethanol, are fuel substitutes which when added in low percentages to the hydrocarbons offer the advantage of providing a fuel mixture requiring no modification nor any specific adjustment of the conventional gasoline engines. However it has been observed that these mixtures are very sensitive to traces of water which cause the segregation of the mixture, such that the liquid is separated into two phases of different densities: an upper phase contains most of the hydrocarbons and a lower, polar phase rich in alcohol. This segregation phenomenon is more pronounced at lower temperatures of the mixture. The concentration of water in the mixture which causes the segregation is termed the "segregation threshold," and is related to the temperature of the mixture. In practice it is nearly impossible to rigorously prevent water presence in this type of mixture because of the mixture's inevitable contact with humid atmospheres during storage, shipping and marketing. Illustratively a content of 500 ppm of water suffices to segregate a mixture at 11° C. of 5% methanol and 95% premium fuel.

U.S. Pat. No. 4,279,620 describes a process for stabilizing a mixture of premium fuel and ethanol, wherein the mixture is dried by being placed in contact with a saturated $CaCl_2$ solution and with solid $CaCl_2$. It is a fairly tricky matter to implement this process in two stages and moreover, as the calcium chloride becomes deliquescent after hydration, it becomes the source of serious difficulties where the process takes place in industry and continuously with a fixed bed.

In industry, the presently used water-adsorbents used in a fixed bed are mainly alumina, molecular sieves and silica gel. However the regeneration of the former two adsorbents takes place at high temperatures (250° to 300° C.) and leads to substantial power consumption, which if, resorted to, would unfavorably affect the overall energy efficiency of the alcohol fuels. While silica gel can be regenerated at lower temperatures, it is on the other hand mechanically fragile and thereby requires care when being used.

Furthermore the inventors have noted in the lab that the water adsorption kinetics of these adsorbents is low in the alcohol/hydrocarbon medium and therefore the application of these adsorbents presents difficulties in industry and in the fixed-bed method.

An object of the present invention is to provide a novel treatment method for alcohol-containing fuels in order to prevent segregation of the fuel mixture and to stabilize their homogeneity.

One of the main objectives of the invention is to provide a method which is economical of energy.

Another object is to ensure rapid treatment so as to make possible treating large amounts of fuels with moderate amounts of adsorbents.

Another object is to enable continuous industrial implementation of fuel conditioning.

Still another object of the invention is to provide a novel adsorbent offering preferential affinity for water and permitting drying in the presence of polar compounds.

DESCRIPTION OF THE INVENTION

The treatment method which is the object of the present invention applies to fuels which comprise a mixture of hydrocarbon(s) and alcohol(s) with a content by volume of alcohol of less than 10%; this method comprises placing the mixture in the presence of at least one cationic ion-exchange resin that can intensively dissociate in ion form in an aqueous medium so as to absorb part of the water dissolved in said mixture for the purpose of restricting the water content to a value less than the segregation threshold of the mixture at the minimum temperature of operation.

Experiment has shown that these ion-exchange resins are capable of selectively fixing the water dissolved in the alcohol/hydrocarbon mixture, and that they can do so with high efficiency whereby it is possible to easily lower the water content of the fuel below a segregation threshold limit (even in the case of a low threshold corresponding to low operational temperatures of the fuel). These resins can be regenerated at low temperatures (about 120° C.), whereby the method of the invention requires only little heat.

To date the ion-exchange resins have been used industrially solely for demineralization or sweetening by ion-exchange. However some scientific documents suggest that these resins have adsorbing properties for various compounds and in particular for water (C. E. WYMORE, "Sulfonic-type cation-exchange resins as dessicants", *Ind. Eng. Chem. Prod. Res. Develop.*, 1962, Vol. 1, No. 3. pp 173–8; J. A. BOHORQUEZ, "Application des resins cationiques fortes au sechage des solvants organiques", *Bull. Soc. Chim. de France,* 1982, No.5–6, Part I, pp 193–6 and pp 197–201). However it is well known to the scientists specializing in these types of resins that the effective range of such resins is restricted to the non-polar organic media.

Accordingly experiments carried out in polar organic media, in particular in an alcohol medium, have shown that these resins evince only very low selectivity for water. They fix equally well the alcohol and the water molecules, and are incapable of eliminating traces of water dissolved in an alcohol. Therefore, the Wymore article states on p 173 that "Very polar substances such as the lower alcohols are difficult to dry", and on page 175 "As regards ethanol, resin performance depends on their relative kinetics of water adsorption because ethanol is difficult to dry, the kinetics assumes a larger role in the overall resin performance . . . The alcohol penetrating the resin appears to become competitive with water as regards the hydrogen ions.

Similarly, the Bohorquez article states as follows about polar solvents and in particular about ethanol:

P. 195: "In spite of being in contact for more than 24 hours and despite using amounts of dry resin substantially larger than those used with benzene, we observed no selective water adsorption at all in those solvents. It may be concluded that with respect to fixing water molecules, there is competition between resin and solvent. Also, considering the polar nature of the solvent molecules, it is the set of dissolved-water and solvent which enters the resin pore and causes it to swell. Accordingly, the amount of water fixed by the resin is very low. Therefore we assumed that the ion exchange resins of the strong cation type are inefficient for drying polar liquids".

Accordingly the prior art teaches that the resins under consideration are incapable of selectively fixing water and would preferentially fix alcohol over the water to be eliminated and contained in the mixtures of alcohol and hydrocarbon. The inventors rejected this bias and have shown by experiment that the resins under consideration evince selective water-adsorption in an alcohol/hydrocarbon medium, making it possible to eliminate most of the water initially present. This unexpected result presently is difficult to explain. Tests have shown that this selective water-adsorption remains effective if the alcohol content remains less than about 10%. This range of efficiency covers the legal range of the composition of the mixtures of alcohol/hydrocarbon fuels (ARRETE of 9 October 1983 in the French Official Gazette)

DESCRIPTION OF PREFERRED EMBODIMENTS

Figure 1:
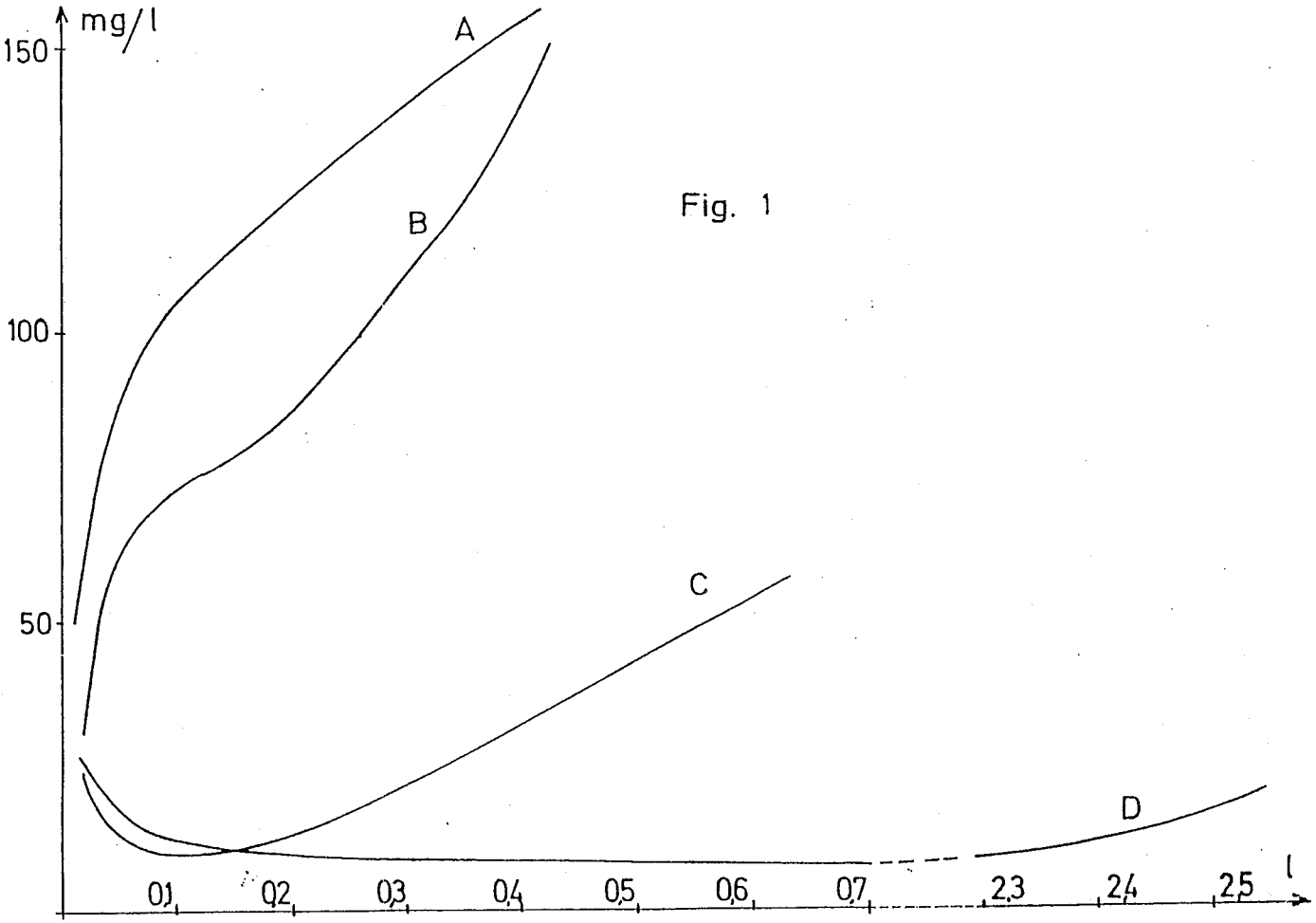

In a preferred mode of implementation, one or more cation resins prepared in the form of alkaline or alkaline earth salts are used. This kind of resin offers the advantage of remaining free of any degradation and therefore will retain all its adsorptive powers during regeneration.

Furthermore the resin(s) above are advantageously prepared in the form of potassium or magnesium; it is also possible to simultaneously use the two resin ion forms.

The resin prepared in the form of potassium offers the advantage of a high kinetic rate of adsorption and therefore is especially well suited for continuous operation, the fuel being caused to cross a fixed resin bed. The resin prepared in the form of magnesium presents a much lower kinetic rate but on the other hand has very high adsorptivity (about 5 times higher than the potassium). Therefore the magnesium resin is better suited for discontinuous operation in which it remains in situ in the fuel over long periods of time. The combination of the two resins and of the two implementing modes in some applications will allow meeting both a rapid increase in water content in the fuel (requiring rapid trapping) and a slow change of this content (requiring overall fixing of large amounts of water).

Experiment appears to show that the strong cation sulfonic resins are preferable; however other resins also lead to good results, in particular the weak cation carboxylic resins.

In particular one may apply the method of the invention to the mixtures of methanol and hydrocarbon(s), or ethanol and hydrocarbon(s) which may contain a diluent agent comprising a higher molecular weight alcohol, in particular tertiary butanol. The hydrocarbon may just as well be premium fuel as regular.

The comparative Examples shown further below relate to a fuel of known formulation (typically known as "M3B2") which contains by volume (within about 1%) 95% premium fuel, 3.5% methanol and 2% tertiary butanol.

The invention also covers an adsorption product which is water-selective in the presence of polar compounds and includes at least one cation resin capable of strong dissociation into ion form in an aqueous medium and prepared in such a manner that it bears on its ion sites either $K^+$counterions, or $Mg^{++}$ counterions, or a coupling of two $K^+$, $Mg^{++}$ counterions.

The resin(s) of the adsorption product comprise in particular strong cation sulfonic resins or weak cationic carboxylic resins.

EXAMPLE 1: Fixed-Bed Processing

The dry adsorbent is introduced into a column of an inside diameter D=1.5 cm to a height of 10 cm. The M3B2 fuel is made to traverse the bed from the top to the bottom at a flow of 0.42 l/h (crossing speed: 0.066 cm/s). The initial water content of this fuel is 720 mg/l in this Example. The water content is measured at the exit from the bed.

The experiment was carried out for the four following cases:

A. The adsorbent is Gamma type activated alumina (grain size: 2 to 5 mm);

B. The adsorbent is silica gel (grain size: 3 to 6 mm);

C. The adsorbent is a molecular sieve of $3\times10^{-10}$ m (extruded, 1.6 mm);

D. The adsorbent is one of the invention.

In this Example, the adsorbent of the invention (D) is a sulfonic cationic resin, prepared in the potassium form, having a structure comprising styrene-divinylbenzene copolymer, type "X8"(bridge ratio 8% of divinylbenzene). The granulometry of this resin is between 50 and 100 mesh (DOWEX 50W resin made by Dow Chemical).

The curves A, B, C, D of FIG. 1 show the respective results for these four adsorbents (the abscissa is the cumulative amount of treated fuel, and the ordinate is the fuel water content at the exit).

It is seen graphically from FIG. 1 that the adsorbent of the invention is by far the most efficient and allows fixing substantially larger amounts of water than the others, and hence treating more substantial volumes of fuel for a given amount of applied adsorbent.

EMAMPLE 2: Discontinuous Operation

A volume of 250 $cm^3$ of M3B2 fuel with a water con of 650 mg/l is placed in a number of flasks. An increasing amount of dry adsorbent is placed in each flask, which is hermetically sealed and agitated until there is liquid/solid equilibrium. Thereupon the concentration of residual water in each flask is measured by the Karl-Fischer method. The values so defined are used in plotting the isotherms of the particular adsorbent.

These experiments were carried out on the two following adsorbents:

E. $3\times10^{-10}$ m molecular sieve identical with previous one,

F. An adsorbent according to the invention.

The adsorbent of the invention used in this Example (F) is a sulfonic cationic resin prepared in the form of magnesium and with the same bearing structure as above.

Figure 2:
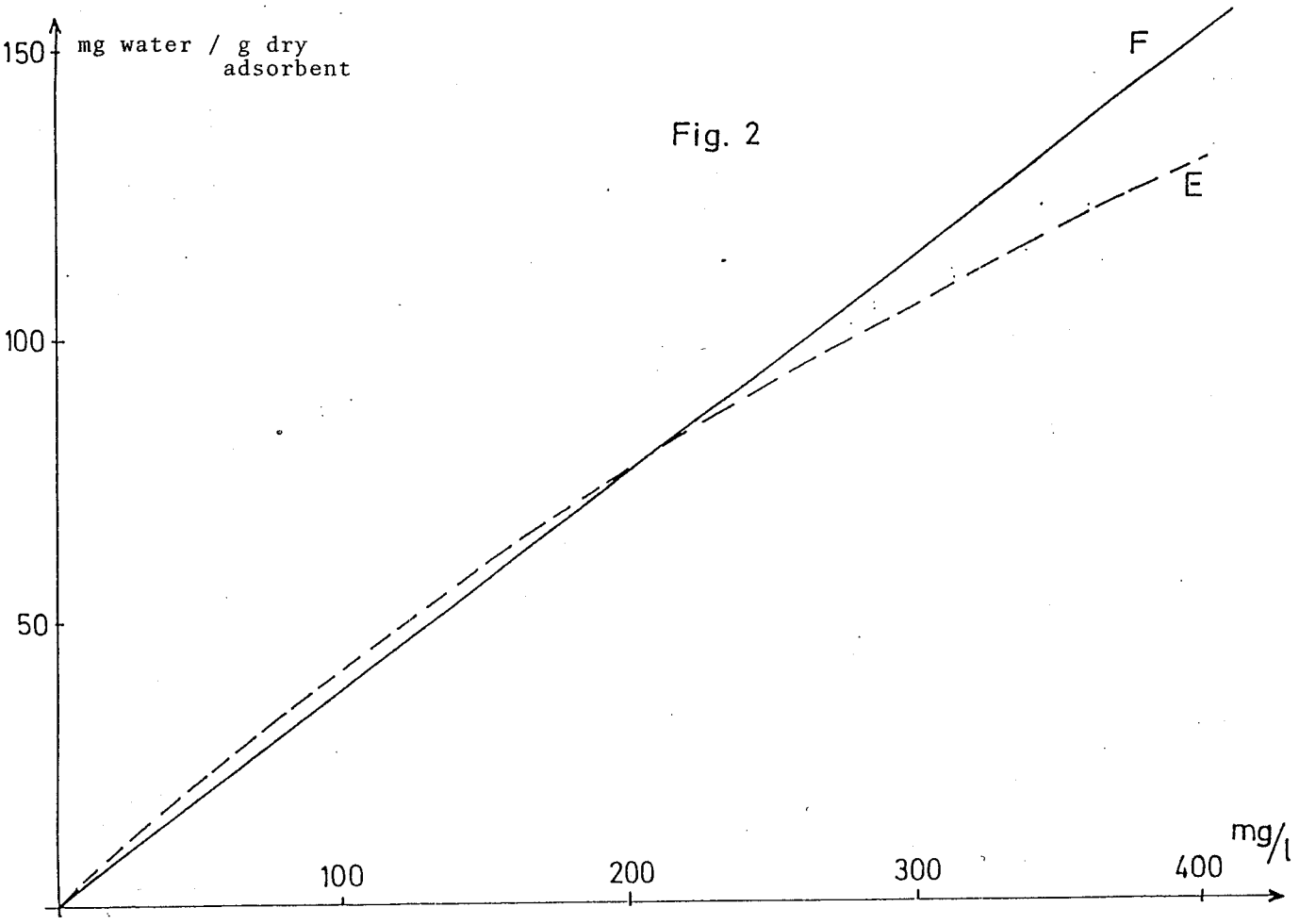

The curves E and F of FIG. 2 respectively correspond to the isotherms of these two adsorbents (the abscissa being the equilibrium water content of the fuel in mg/l and the ordinate being the equilibrium water content in mg of water per gram of dry adsorbent). The resin of the invention has an adsorptivity which is equivalent to or even superior to that of the molecular sieve, which is considered remarkable.

The essential advantage of the resin of the invention is on one hand that its manufacturing cost is much less and on the other hand that it regenerates at low heat intakes (120° to 140° C.), whereas the molecular-sieve regeneration requires temperatures of about 250° to 300° C.

Using the isotherm F relating to the adsorbent of the invention, it is possible in each case to determine the amount of resin to be employed. Illustratively, if a M3B2 fuel is to be used at a lowest temperature of −24° C., the segregation threshold is about 800 ppm of water by weight.

If a tank holding 50,000 liters of M3B2 with a water content of 1,500 ppm by weight is considered, about 360 kg of the resin above must be used to achieve equilibrium at a content of 400 ppm (safety coefficient equal to 2).

If an equilibrium content of 800 ppm is satisfactory, the amount of resin to be used is only 120 kg approximately.

By deriving an analytical expression of the isotherm from the empirical data, it is possible to show that the mass M (in kg) of resin to be used to lower the content of 1 $m^3$ of M3B2 mixture from the value C° to the value C (in mg/1) will be given by:

$$M = \frac{(Co - C)}{0.476\ C^{0.962}}$$

We claim:

1. A method for treating a fuel which comprises a mixture of hydrocarbon(s) and alcohol(s) for stabilizing the homogeneity of said mixture at its lowest temperature of operation, said method comprising placing said mixture in contact with at least one cationic ion exchange resin prepared in the form of an alkali metal or alkaline earth metal salt and capable of strongly dissociating into ion form in an aqueous medium for absorbing at least a portion of any water dissolved in said mixture and for limiting the water content of said mixture to a value less than the segregation threshold of said mixture at the lowest operational temperature.

2. A method for treating a fuel as in claim 1, and including placing the fuel in contact with a resin prepared in potassium form.

3. A method for treating a fuel as in claim 1, and including placing the fuel in contact with a resin prepared in magnesium form.

4. A method for treating a fuel as in claim 1, and including placing the fuel in contact with two resins, one of which is prepared in potassium form and the other in magnesium form.

5. A method for treating a fuel as in claim 1 and wherein said resin comprises one or more strong cationic sulfonic resins.

6. A method for treating a fuel as in claim 1 and wherein said resin comprises one or more weak cationic carboxylic resins.

7. A method for treating a fuel as in claim 1 and including causing the fuel to traverse a fixed bed of said resin(s).

8. A method for treating a fuel as in claim 1 and wherein said fuel comprises a mixture of hydrocarbon(s) and methanol.

9. A method for treating a fuel as in claim 1 and wherein said fuel comprises a mixture of hydrocarbon(s) and ethanol.

10. A method for treating a fuel as in claim 8 and wherein said fuel contains a diluent agent comprising a high molecular weight alcohol.

11. A method for treating a fuel as in claim 9 and wherein said fuel contains a diluent agent comprising a high molecular weight alcohol.

12. A method for treating a fuel as in claim 1 and wherein said fuel comprises a mixture of premium fuel and alcohol(s).

13. A method for treating a fuel as in claim 10 and wherein said fuel comprises by volume substantially 95% of premium fuel, 3% of methanol and 2% of tertiary butanol.

14. A composition for selectively adsorbing water in the presence of polar compounds, including at least one cationic resin capable of strong dissociation into ion form in an aqueous medium and having at its ion sites ions selected from the group consisting of $K^+$, $Mg^{++}$, a mixture of $K^+$ and $Mg^{++}$ ions.

15. A composition as in claim 14 and wherein said resin is a strong cationic sulfonic resin.

16. A composition as in claim 14 and wherein said resin is a weak cationic carboxylic resin.

* * * * *